US011264226B2

(12) United States Patent
Kaposi et al.

(10) Patent No.: US 11,264,226 B2
(45) Date of Patent: Mar. 1, 2022

(54) PARTLY SEALED ION GUIDE AND ION BEAM DEPOSITION SYSTEM

(71) Applicant: Technische Universität München, Munich (DE)

(72) Inventors: Tobias Kaposi, Landsberg am Lech (DE); Hartmut Schlichting, Gilching (DE); Johannes Barth, Garching (DE); Andreas Walz, Munich (DE)

(73) Assignee: TECHNISCHE UNIVERSITÄT MÜNCHEN, Munich (DE)

( * ) Notice: Subject to any disclaimer, the term of this patent is extended or adjusted under 35 U.S.C. 154(b) by 0 days.

(21) Appl. No.: 17/045,433

(22) PCT Filed: Apr. 5, 2019

(86) PCT No.: PCT/EP2019/058678
§ 371 (c)(1),
(2) Date: Oct. 5, 2020

(87) PCT Pub. No.: WO2019/193170
PCT Pub. Date: Oct. 10, 2019

(65) Prior Publication Data

US 2021/0043436 A1 Feb. 11, 2021

(30) Foreign Application Priority Data

Apr. 5, 2018 (EP) ..... 18165948
Apr. 5, 2018 (EP) ..... 18165949
Apr. 5, 2018 (EP) ..... 18165950

(51) Int. Cl.
*H01J 49/06* (2006.01)
*H01J 49/00* (2006.01)
(Continued)

(52) U.S. Cl.
CPC ..... *H01J 49/066* (2013.01); *H01J 49/0031* (2013.01); *H01J 49/022* (2013.01);
(Continued)

(58) Field of Classification Search
CPC .... H01J 49/066; H01J 49/0031; H01J 49/022; H01J 49/063; H01J 49/068; H01J 49/065;
(Continued)

(56) References Cited

U.S. PATENT DOCUMENTS 3,867,632 A 2/1975 Fite
3,936,634 A 2/1976 Fite
(Continued)

FOREIGN PATENT DOCUMENTS

GB 2416913 A 2/2006
RU 817801 2/2006
(Continued)

OTHER PUBLICATIONS

MassTech: "Two Stage Ion Funnel for Thermo Mass Spectrometers; Installation, Operation, and Maintenance Manual", Oct. 12, 2017.
(Continued)

*Primary Examiner* — Kiet T Nguyen
(74) *Attorney, Agent, or Firm* — Steven J. Grossman; Grossman, Tucker, Perreault & Pfleger PLLC

(57) ABSTRACT

Disclosed herein is an ion guide for guiding an ion beam along an ion path, said ion guide having a longitudinal axis which corresponds to said ion path. Said ion guide comprises a plurality of electrode plates which are arranged perpendicularly to the longitudinal axis, each electrode plate having an opening and being arranged such that said longitudinal axis extends through its respective opening, wherein said openings collectively define an ion guide volume. The ion guide extends or is configured to extend through a separation wall separating adjacent first and
(Continued)

second pumping chambers. The ion guide has a first portion, in which gaps are formed between at least some of said electrode plates such that uncharged gas can escape from said ion guide volume, wherein said first portion is completely located in said first pumping chamber. A second portion, in which sealing elements are arranged between adjacent electrode plates, prevents neutral gas from escaping from that portion of the ion guide volume between adjacent electrode plates, said second portion extends at least from said separation wall into said second pumping chamber.

21 Claims, 5 Drawing Sheets

(51) Int. Cl.
*H01J 49/02* (2006.01)
*H01J 49/42* (2006.01)

(52) U.S. Cl.
CPC ..... *H01J 49/063* (2013.01); *H01J 49/068* (2013.01); *H01J 49/4215* (2013.01); *H01J 49/4225* (2013.01); *H01J 49/4255* (2013.01)

(58) Field of Classification Search
CPC . H01J 49/4215; H01J 49/4225; H01J 49/4255
USPC ..... 250/290, 292
See application file for complete search history.

(56) References Cited

U.S. PATENT DOCUMENTS

| | | | | |
|---|---|---|---|---|
| 3,937,954 | A | 2/1976 | Fite | |
| 4,013,887 | A | 3/1977 | Fite | |
| 4,283,626 | A | 8/1981 | Siegel | |
| 4,814,613 | A | 3/1989 | Fite et al. | |
| 4,885,500 | A | 12/1989 | Hansen et al. | |
| 5,652,427 | A | 7/1997 | Whitehouse et al. | |
| 6,441,370 | B1 | 8/2002 | Khosla et al. | |
| 7,582,861 | B2 | 9/2009 | Mukaibatake | |
| 7,595,486 | B2 | 9/2009 | Franzen | |
| 8,003,938 | B2 | 8/2011 | Brekenfeld | |
| 8,822,918 | B2 | 9/2014 | Taniguchi | |
| 9,287,103 | B2 | 3/2016 | Baba | |
| 2003/0136905 | A1 | 7/2003 | Franzen et al. | |
| 2003/0157269 | A1 | 8/2003 | Ratner et al. | |
| 2003/0178564 | A1 | 9/2003 | Kernan et al. | |
| 2004/0051038 | A1* | 3/2004 | Taniguchi ..... | H01J 49/065 250/288 |
| 2005/0189486 | A1* | 9/2005 | Fuhrer ..... | H01J 49/004 250/287 |
| 2006/0108520 | A1* | 5/2006 | Park ..... | H01J 49/107 250/287 |
| 2010/0102221 | A1 | 4/2010 | Brekenfeld | |
| 2010/0301210 | A1 | 12/2010 | Bertsch et al. | |
| 2014/0361163 | A1 | 12/2014 | Taniguchi et al. | |
| 2014/0374589 | A1 | 12/2014 | Javaheri et al. | |
| 2016/0035556 | A1 | 2/2016 | Berkout et al. | |
| 2016/0322209 | A1 | 11/2016 | Wouters et al. | |
| 2017/0350860 | A1 | 12/2017 | Rather et al. | |

FOREIGN PATENT DOCUMENTS

| | | |
|---|---|---|
| WO | 2005114705 | 1/2006 |
| WO | 19950023018 | 2/2006 |
| WO | 2013124364 | 8/2013 |
| WO | 201457345 | 4/2014 |
| WO | 2001013100 | 2/2020 |

OTHER PUBLICATIONS

International Journal of Mass Spectrometry and Ion Physics, "A New Operating Mode for the Quadrupole Mass Filter" (1973) pp. 317-339.

Guzowski, J., et al., "Characteristics of a rf-only hexapole ion-guide interface for plasmasource time-of-flight mass spectrometry," J. Anal. At. Spectrom, 2001, 16, pp. 781-792.

Von Zahn, U. Präzisions-Massenbestimmungen mit dem elektrischen Massenfilter. Z. Physik 168, 129-142 (1962). (absract in English only).

* cited by examiner

PARTLY SEALED ION GUIDE AND ION BEAM DEPOSITION SYSTEM

BACKGROUND

Ion beams have many uses in various fields of natural sciences and technology, including experimental physics, medical devices, electronic components manufacturing or life science, in particular mass spectroscopy, where electrically charged molecules (ions) are guided to, from or within a mass spectrometer or a collision cell. The general purpose of an ion guide is to confine an ion beam along its predetermined path, typically using a plurality of electrodes arranged around the ion path, which in combination generate an electrical potential guiding the ions. In the simplest case, the potential could be a static DC potential, which would typically be realized as an ion Einzel lens arrangement. This, however, demands a fixed correlation of the ions' radial and axial momentum to keep them on track. Any breaking of this correlation e.g. due to collisions with residual gas atoms makes the ions swerve and lose track. These conditions are very common at relatively high pressure in the first stages of a multistage ion guide system, or in collision cells or drift cells, but can also occur due to space charge effects in later stages.

To make an ion guide more resistant to such perturbations, systems of electrodes can be employed which are driven with radio frequency (RF) voltages having frequencies of about 0.5 to 5 MHz and amplitudes of some volts up to some 100 volts. When the amplitude and the frequency of the RF potential are properly chosen, ions will be effectively repelled from the RF electrodes by means of an effective potential or "pseudo-potential" which reflects the effect of the RF electric field on the ion averaged over a plurality of AC cycles. A repulsive force derivable from this pseudo-potential, the so-called "field gradient force", is proportional to the gradient of the square of the RF field strength, proportional to the square of the charge of the ion—and hence independent of its polarity—and inversely proportional to the ion mass and to the square of the RF frequency.

In most RF operated ion guide systems, adjacent electrodes are driven with sinusoidal voltages of opposite phase, i.e. with a phase shift of 180° in between. For example, in known multipole ion guides, four, six or eight rod electrodes may be arranged on a circle around and extending parallel to the ion path, thereby forming a quadrupole, hexapole or octopole structure, respectively. In a different design, which is referred to as a stacked ring ion guide in the art, a plurality of ring like electrodes are stacked such as to form a tube-like structure, and each adjacent two ring electrodes are driven with voltages of opposite phase to thereby confine ions within a volume extending through the rings.

While there are many purposes for ion guides in various fields of science and technology, and the present invention is not restricted to use in a specific one of them, the ion guide of the present invention is particularly suitable for use in ion beam deposition (IBD), mass spectroscopy (MS), such as triple quad, Orbitrap or quadrupole time-of-flight (Q-TOF) mass spectroscopy, or in ion mobility spectroscopy (IMS) systems.

In IBD, ions are guided along an ion path through a series of pumping chambers with decreasing pressure prior to being deposited by means of so-called "soft landing" on a substrate or target. The purpose of the pumping chambers is to remove unwanted, neutral particles from the ion beam. Ion beam deposition has important advantages over conventional deposition techniques. For example, unlike sputtering, plasma spraying, physical vapor deposition (PVD) and atomic layer deposition (ALD), IBD is not restricted to the deposition of thermally stable molecules. Chemical vapor deposition (CVD) requires a chemical reaction between sometimes poisonous educts on the substrate, which can likewise be avoided using IBD. Finally, while spincoating is restricted to (on an atomic scale) large thicknesses, IBD allows for depositing layers of a defined atomic thickness.

Moreover, since an ion beam can be deflected using suitable electric fields, in IBD, it is possible to "write" structures on a substrate, in a way similar to mask free ion beam lithography. Accordingly, it is possible to position highly sensitive, thermolabile molecules with low masses, like amino acids up to molecules with high masses, like peptides, proteins or even DNA molecules with a layer thickness defined on an atomic scale in micro arrays for manufacturing assays, sensors or highly specific catalysts.

All of these advantages of IBD currently come at the price of a rather slow deposition speed, which is due to the limited yield of the IBD system in view of the comparatively low intensity of the ion beam in current IBD systems.

US 2018/076014 A1 discloses a system and method for sample analysis using sub-atmospheric pressure (sub-AP) laser ionization. The sub-AP ion source includes a holder with a sample containing analyte molecules, a pulsed laser beam configured to generate ionized species from the sample, an ion extractor adjacent to the holder configured to extract analyte ions from the ionized species by an extraction electric field near the sample, and an ion funnel structure composed of orifice electrodes located along an ion funnel pathway direction z. The ion funnel structure has an entrance and an exit, the exit being the electrode with the smallest aperture in the structure. This structure is configured for accepting the analyte ions from the ion extractor at the entrance and dragging them toward the exit using an axial electric field. The extraction electric field is at least partly electrically shielded from the axial electric field.

US 2002/063207 A1 discloses a mass spectrometer comprising an ion guide which spans two or more vacuum chambers. The ion guide comprises a plurality of electrodes having apertures. One of the electrodes may also form the differential pumping aperture which separates two vacuum chambers.

GB 2 416 913 A discloses a centrifugal particle mass analyzer removes particles from an aerosol except those close to a desired mass to charge ratio by holding the desired particles in a rotating flow between two electrodes between which an electric field exists, forming a classifier channel therebetween. Other particles strike the electrodes. The analyzer is constructed so that the electric field is not inversely proportional to the required centripetal acceleration of the particles, thereby providing a stable classification of the particles. The electrodes are supported on mounts which serve as sidewalls for the classifier channel. These mounts are manufactured from a material which allows a strong electric field to be imposed between the electrodes but which prevents the accumulation of static charges on the side walls, such as statically dissipative plastic with a resistivity between $10^9$ and $10^{12}$ Ohm·cm.

US 2017/350860 A1 discloses a trapped ion mobility spectrometer and proposes to use higher order (order N>2) linear multipole RF systems to accumulate and analyze ions at an electric DC field barrier, either pure higher order RF multipole systems or multipole RF systems with transitions from higher order towards lower order, e.g. from a linear octopolar RF system (N=4) to a linear quadrupole RF system (N=2) in front of the apex of the electric DC field barrier. An RF ion guide of the TIMS device is built by rolling or folding printed circuit boards (PCBs) carrying electrodes for generating radial RF fields and axial DC fields. The surface of the PCB is covered with a high-resistance coating to prevent charging up by ions, where the envisaged specific surface resistance is between $10^9$ to $10^{12}$ Ohms.

SUMMARY OF THE INVENTION

The problem underlying the invention is to provide an ion guide with improved properties which in particular allows for increasing the yield of an IBD system, as well as an improved IBD system, and a method for guiding an ion beam along an ion path.

This problem is solved by an ion guide according to claim 1, an ion beam deposition system according to claim 26, a method for guiding an ion beam along an ion path according to claim 27, an ion guide suitable for use as a second portion of an ion guide according to claim 1, as well as suitable manufacturing methods.

According to one aspect of the invention, an ion guide for guiding an ion beam along an ion path is provided, said ion guide having a longitudinal axis corresponding to said ion path, wherein said ion guide comprises a plurality of electrode plates which are arranged perpendicularly to the longitudinal axis, each electrode plate having an opening and being arranged such that said longitudinal axis extends through its respective opening, wherein said openings collectively define an ion guide volume. In operation, said electrode plates are to be connected to an RF driving source for driving adjacent two electrode plates with voltage of opposite polarity. The ion guide of the invention extends or is configured to extend through a separation wall separating adjacent first and second pumping chambers. Said ion guide has a first portion, in which gaps are formed between at least some of said electrode plates such that uncharged gas can escape from said ion guide volume, wherein said first portion is completely located or configured to be located in said first pumping chamber, and a second portion, in which sealing elements are arranged between adjacent electrode plates, preventing neutral gas from escaping from that portion of the ion guide volume between adjacent electrode plates, said second portion extending at least from said separation wall into said second pumping chamber.

The yield of an IBD system or related systems employing an ion beam guided through a number of consecutive pumping chambers is governed by the ion current that can be guided through the ion guide system, which is referred to as the "current capacity" of the ion guide or ion guide system herein. The obvious way to increase the current capacity would be to increase the diameter of the ion guide or ion guides as a whole. However, larger diameter ion guides naturally come along with larger apertures in the separation walls through which the ions are guided from one pumping chamber to the other. This in turn makes it more difficult to decrease the number of neutral particles in the ion beam by means of pumping. The flow of neutral particles in common with the ion beam is referred to as "gas load" in the following. In other words, the inventors noticed that when increasing the diameter of the apertures in the separation walls, eventually more pumping stages are necessary to reduce the gas load to a desired degree. A larger number of pumping chambers however increases the manufacturing and operating costs and extends the ion path, leading to an inherent increase of ion losses. In other words, for a favorable ion guide system, it would be desirable to increase the current capacity but at the same time keep the gas load low.

The ion guide of the invention has proven particularly advantageous in this regard. Contrary to typical ion guide systems involving a plurality of consecutive pumping chambers, where individual ion guides are provided in individual chambers, the ion guide of the invention extends through the separation wall separating adjacent pumping chambers, and hence allows for optimum guiding of ions at the most critical point, namely at the transition between adjacent pumping chambers, thereby avoiding ion losses.

Moreover, for decreasing the gas load, it is important to decrease the gas conductance through the structure at the interface of adjacent pumping chambers. If this structure should be a simple opening in a wall, the gas conductance is, at least for moderate pressures, approximately proportional to the area of the opening. However, in the framework of the present invention, the "structure at the interface" is formed by the gas-tight second portion of the ion guide, which extends at least from said separation wall into said second pumping chamber. Herein, the term "at least" indicates that the second portion may also be partly located in the first pumping chamber. The sealed, gas-tight second portion forms a "tube" rather than a simple aperture, said tube having a gas conductance which is significantly reduced as compared to that of a simple opening of same diameter, and may under certain circumstances in fact be roughly proportional to the inverse of the length of the second portion. The "tube-like" structure of the second portion is also referred to as a "tunnel" herein. Accordingly, if one is able to safely introduce the ions into the second portion or "tunnel" and avoid or minimize losses during passage through the tunnel, the current capacity can be maintained while the gas load is reduced.

Safely introducing the ions into the second portion or "tunnel" is facilitated by the first portion of the ion guide which allows for receiving ions and guiding them into the tunnel, while at the same time allowing for removing neutral gas through the gaps between the electrode plates. The first, gas permeable portion of the ion guide is also referred to as a "funnel" herein, since it serves for introducing the ions into the gas-tight second portion or tunnel. This may, but need not necessarily involve the electrode plates in the first portion to define a tapering or funnel-shaped ion guide volume, which is referred to as "funnel structure" herein. Since the ion guide of the invention involves both, a tunnel section in combination with a funnel section, it is also referred to as "TWIN ion guide" herein.

In a preferred embodiment, some or all of said sealing elements are made from an intermediate resistivity material having an electrical resistivity of between $10^2$ Ohm·cm and $10^{12}$ Ohm·cm, preferably of between $3.10^5$ Ohm·cm and $10^9$ Ohm·cm, or have a sheet resistivity of $10^4$ Ohm and $10^{14}$ Ohm, preferably of between $3.10^7$ Ohm and $10^{10}$ Ohm on a surface facing said ion guide volume. The intermediate resistivity material is sufficiently resistive to keep currents between adjacent electrode plates upon RF driving within tolerable bounds while at the same time allowing for draining the charge of stray ions that may hit the sealing elements during operation. This way, it can be avoided that the sealing elements are charged by stray ions from the ion beam, which would lead to a distortion of the electric field for guiding the ion beam and in consequence to a reduction of the current capacity.

However, an appropriate draining of charge can also be achieved if the sheet resistivity on a surface facing the ion volume, preferably any surface facing the ion guide volume is between $10^4$ Ohm and $10^{14}$ Ohm, preferably between $3.10^7$ Ohm and $10^{10}$ Ohm. Such a surface resistivity can be obtained using the aforementioned intermediate resistivity materials, but can also be obtained by suitably coating a carrier with a coating of suitable conductivity, where the carrier may then e.g. be an electrical insulator.

In a preferred embodiment, the intermediate resistivity material is a plastic material or a ceramic material including or mixed with conductive particles, in particular metal or graphite particles. Herein, the term "particle" shall have a broad meaning and not suggest any specific geometry. In particular, the term "particle" shall cover e.g. elongate particles having high aspect ratios, such as nanowires or the like. In addition or alternatively, ferrite based materials can be employed. It is important that the electrical resistivity of the intermediate resistivity material does not significantly change with temperature, or that the resistivity values fall within the above mentioned boundaries throughout the range of temperatures that the sealing elements may acquire during normal operation of the ion guide. Temperature changes are expected to occur due to heating of the electrode plates caused by the RF currents, and since the ion guide is typically employed in a vacuum, there is no cooling by convection. For this reason, conventional semiconducting materials are not preferred as intermediate resistivity materials, because the resistance would tend to drop too much in the course of heating up during operation of the ion guide.

In a preferred embodiment, said intermediate resistivity material is a material suitable for 3D printing, and in particular and in particular a plastic material mixed with graphene, carbon nanotubes, carbon fibers, soot, graphite or metal or a ceramic material mixed with metal or metal oxides.

In preferred embodiments, some or all of said sealing elements are coated at least on a, surface facing said ion guide volume, preferably any surface facing the ion guide volume with a coating suitable for draining the charge of stray ions to thereby avoid static charging of said sealing elements by stray ions.

Herein, said coating may be a metal film having a thickness of 30 to 1000 nm, or a paste containing glass and metal oxides, wherein said paste preferably has a thickness of 5 to 1000 μm. This "paste" is also referred to as "cermet" in the art.

In a preferred embodiment, at least some of the sealing elements are flush with the opening in one or both of its adjacent electrode plates, or are retracted from the opening in one or both of its adjacent electrode plates in a radially outward direction by less than 3 times, preferably by less than 1.5 times and most preferably by less than 1.0 times the distance between the corresponding adjacent electrode plates. In the embodiment when the sealing elements are flush with the openings in the adjacent electrode plates, the overall volume of the tunnel is the smallest, which again allows for a low gas conductivity. However, retracting the sealing elements at least a little bit from the openings in the electrode plates leads to a "rough" surface of the tunnel formed by the second portion, adding turbulences to the neutral gas flow and thereby further increasing the flow resistance. Since in this embodiment the sealing elements may extend to or at least close to the ion guide volume, the risk that the sealing elements might be hit by stray ions is increased. However, using the preferred sealing elements made from an intermediate resistivity material or having the above-mentioned sheet resistivity at least at a surface facing the ion guide volume, preferably any surface facing the ion guide volume, this risk is tolerable, since this will not lead to inadvertent charging of thereof. If the sealing elements are sufficiently far retracted from the opening in one or both of its adjacent electrode plates in a radially outward direction, the risk of being hit by stray ions becomes sufficiently low such that the sealing elements do not need to have a resistivity or sheet resistivity suitable for draining ions, but may be formed by insulating material.

In a preferred embodiment, at least some of the electrode plates in the second portion are likewise made from a material suitable for 3D printing, in particular a plastic material mixed with graphene, carbon nanotubes, carbon fibers, soot, graphite or metal or a ceramic material mixed with metal or metal oxides. This way, the entire second portion (i.e. the tunnel portion) of the ion guide, including electrode plates and sealing elements, can be manufactured by 3D printing, which greatly reduces manufacturing costs and efforts. Commercially available 3D printing devices allow for adding layers of different materials on top of each other. This typically requires that the melting temperatures of the two materials are at least close to each other, such that an underlying layer is not melted or softened when the successive layer is placed on top of it. When forming the second portion of the ion guide, it is possible to use the same or similar plastic materials with different concentrations of conductive particles dispersed therein for forming the "electrode plates" and the "sealing elements", respectively, where the "electrode plates" and the "sealing elements" then correspond to regions of different resistivity within the same printed object. It is advantageous to print the second portion of the ion guide in an upright position, i.e. with the longitudinal axis in a vertical direction, while consecutively adding horizontal layers corresponding to the electrode plates and the sealing elements, respectively. In some embodiments, the electrode plates and the sealing elements can be printed including their opening. With current 3D printing precision, this is possible if the openings have a diameter of 1 mm or above and the total length of the second portion of the ion guide is for example 100 mm. For smaller openings, it is possible to form the openings using a high precision drill later on. It is also possible to combine a printing procedure including the openings and a drilling procedure, where the openings in the printed electrode plates and sealing elements may not be quite large enough, but help guiding the drill upon subsequent drilling of the openings. In some embodiments, only the electrode plates and sealing elements are formed by 3D printing, while further components, such as wirings for electrical connection of the electrode plates with a corresponding RF driving source are added in a conventional way. This keeps the 3D printing process comparatively easy and allows for rather rapid manufacturing. In other embodiments, however, the additional external wiring may be made by 3D printing as well.

In a preferred embodiment, the sealing elements are formed by annular discs, wherein said annular discs preferably serve as spacers to adjust the distance between adjacent electrode plates.

Preferably, in one of said first and second portions, and preferably starting in the first portion, the diameters of the openings in at least a subset of consecutive electrode plates decrease in downstream direction of the ion guide, to thereby form a funnel structure. Herein, if the opening should not be circular, the "diameter" shall refer to an effective parameter defined by $\sqrt{A/\pi}$, where A resembles the area of the opening. With such a funnel structure, a "fuzzy" ion beam can be focused prior to being fed into the second portion (i.e. "tunnel"), which in turn allows for guiding the ions through a comparatively narrow tunnel without significant losses, which narrow tunnel allows for a decreased gas conductance and hence a decreased gas load, as explained above.

In a preferred embodiment, in at least a portion of said funnel structure, the quotient of the difference between the diameters of the openings in adjacent electrode plates divided by the distance between these adjacent electrode plates decreases gradually in said downstream direction of the ion guide. This allows for a smooth transition between the "tapered" funnel structure and a subsequent cylindrical or nearly cylindrical portion of the ion guide, which has been found to further increase the current capacity.

In a preferred embodiment, said funnel structure is predominantly formed in said first portion but extends into the second portion of the ion guide. Note that in the first portion, neutral gas flows mainly radially outside through the gaps between adjacent electrode plates, while in the second portion (the tunnel), the neutral gas flows exclusively in a longitudinal direction (toward the second chamber). In other words, at the interface between the first and second portions, the direction of gas flow changes. The inventors have found out that best results with regard to gas load and current capacity can be achieved if this change in gas flow direction does not coincide with the location where the ion beam has reached its maximum concentration. Accordingly, while it is possible to employ a funnel structure in the first portion and a cylindrical structure in the second portion, in preferred embodiments the funnel structure is actually extended into the second portion, such that the ion beam is only maximally concentrated after the change in the gas flow direction from radial to longitudinal has occurred.

In a preferred embodiment, no DC lens is arranged between said first and second portions of said ion guide. Indeed, it is common in prior art ion guides to provide for a DC lens at the exit thereof, which defines the boundary of the RF field generated within the ion guide and controls the further flight of the ions exiting the ion guide, for example by focusing the ion beam. Accordingly, these DC lenses are often referred to as "exit lenses" or "entrance lenses". In the present invention, however, the first and second portions of the ion guide are preferably seamlessly connected with no such DC exit lens being provided between the first and second portions. The inventors have found that this design significantly increases the current capacity of the ion guide.

In a preferred embodiment, the spacing between at least some adjacent electrode plates in the first portion is larger than the spacing between at least some adjacent electrode plates in the second portion by a factor of at least 1.5, preferably by a factor of at least 3. Herein, "larger by a factor of 2" would amount to "twice as large", and "larger by a factor of 1" would mean that the spacings would be the same. Note that a cloud of ions with same polarity within the ion guide leads to a radial repulsive force, and this repulsive force gets larger, the more concentrated the ions are in radial direction. These repulsive forces need to be overcome by the RF field generated by the electrode plates. The strength of the RF field increases with decreasing spacing between adjacent electrode plates. For securely confining the ions within the ion guide volume, and hence maintaining the current capacity, a sufficiently small spacing is needed at regions of the ion guide where the ion beam is the most concentrated, which applies for the second portion thereof. However, at least in part of the first portion, the ion beam is not yet fully focused, leading to lower repulsive forces, such that larger electrode plates spacings will be sufficient. This is accounted for in preferred embodiments of the invention, where the spacing between at least some adjacent electrode plates in the first portion is larger than the spacing between at least some adjacent electrode plates in the second portion by the aforementioned factors of at least 1.5, preferably by at least 3. By avoiding unnecessarily low spacings of electrode plates at regions where they are not needed, the electrical capacity and likewise the driving current of the set of electrode plates can be reduced.

Although the spacings of electrode plates in the first and second portions of the ion guide may be different, it has proven advantageous to provide for a transition region between said first and second portions, in which the spacing between adjacent electrode plates is uniform or at least varies by less than 15%, preferably by less than 5%. Herein, the transition region preferably comprises at least three electrode plates of the first portion. Simply put, the transition region allows for a smooth transition from the larger spacings in the first portion to the smaller spacings in the second portion, which has been found to allow for an improved current capacity.

In a preferred embodiment, said electrode plates are formed by annular elements comprising two or more radially extending mounting portions connected to a corresponding mounting structure, wherein the mounting portions of odd-numbered electrode plates are connected to one or more first common mounting structures, and the mounting portions of the even-numbered electrode plates are connected to one or more second common mounting structures different from said one or more first common mounting structures. As will be explained below with reference to an exemplary embodiment, this allows for avoiding an overlap between mounting portions of adjacent electrode plates which are driven with opposite polarity, and hence for decreasing the electrical capacity of the ion guide. In a related embodiment, the mounting structures are also used for applying a driving voltage to the electrode plates.

In a preferred embodiment, the electrode plates are made from copper, molybdenum, tungsten, nickel, or compounds or alloys thereof, or from stainless steel, and/or the electrode plates are plated with silver or gold.

In various embodiments, the electrode plates in said second portion of the ion guide have a thickness of 3 mm or less, preferably of 1 mm or less, more preferably of 0.3 mm or less, most preferably 0.1 mm or less and of 0.01 mm or more, preferably of 0.02 mm or more and most preferably of 0.03 mm or more.

In preferred embodiments, the average distance between adjacent electrode plates in said second portion of the ion guide is 3 mm or less, preferably 1 mm or less, more preferably 0.3 mm or less, most preferably 0.1 mm or less and 0.01 mm or more, preferably 0.02 mm or more and most preferably 0.03 mm or more.

In preferred embodiments, for at least 10%, more preferably for at least 50% of the electrode plates, the ratio of the diameter of the opening in each electrode plate and the distance to one of its adjacent electrode plates is between 2000 and 1.0, preferably between 2000 and 2.0.

In preferred embodiments, said electrode plates are connected to an RF driving source configured to drive adjacent two electrode plates with voltages of opposite polarity and freely adjustable radiofrequency. Herein, "driving with opposite polarity" typically means that the voltages at adjacent electrode plates are shifted by 180°, such that when at a given point in time the voltage at one electrode plate is positive, the voltage at its directly adjacent electrode plates is negative, and vice versa.

Herein, said RF driving source is preferably configured to drive the electrode plates with an RF square wave signal, or a superposition of RF square wave signals. A nonlimiting example of a "superposition of square wave signals" is a so-called "digital signal" which corresponds to a superposition of square waves with different amplitude and different duty cycle, but at the same base frequency.

Note that RF square wave driving signals or superpositions thereof are uncommon for conventional ion guides, where the electrodes are usually resonantly driven, using an LC circuit established by adding an inductive element and using the inherent capacitance of the electrodes for adjusting the resonance frequency. The inventors have noticed that the specific waveform (i.e. square wave digital waveform versus sinusoidal) has little bearing on the current capacity of the ion guide, but the square wave driving signal can be generated more easily with freely adjustable frequency than a sinusoidal driving signals. In fact, square wave signals can be generated by using switching circuits only, without having to provide for any resonant LC elements. Since the switching frequencies, the duty cycle and the superposition of square waves can be freely adjusted, the digital waveform or any other superposition of square waves can likewise be freely adjusted to thereby provide for optimum ion guiding performance.

In preferred embodiments, the electrode plates are connected to an RF driving source which supplies RF voltages having frequencies freely adjustable between about 0.05 to 20 MHz.

For applying a driving force on the ions in longitudinal direction of the ion guide, a DC electric field may be established along the centerline of the ion guide. For this purpose, in a preferred embodiment, a DC potential gradient is established along the length of at least a part of said second portion of said ion guide by means of a DC current through the corresponding electrode plates and the intermediate resistivity sealing elements arranged in between, by the sheet resistivity of the sealing elements or by external resistors arranged between adjacent electrode plates. Another possible method to establish the DC potential gradient is the usage of external resistors between the adjacent electrode plates which can be applied to the first portion of said ion guide as well.

In a preferred embodiment, said ion guide is part of an ion beam deposition system, in which an ion beam is guided through a plurality of pumping chambers of decreasing pressure, wherein adjacent pumping chambers are separated by separation walls having an aperture for the ion beam to pass through.

A further aspect of the invention relates to an ion beam deposition system comprising at least one ion guide according to one of the embodiments described above.

A further aspect of the invention relates to a method for guiding an ion beam along an ion path using an ion guide, said ion guide having a longitudinal axis corresponding to said ion path, wherein said ion guide comprises a plurality of electrode plates which are arranged perpendicularly to the longitudinal axis, each electrode plate having an opening and being arranged such that said longitudinal axis extends through its respective opening, wherein said openings collectively define an ion guide volume, wherein the ion guide extends through a separation wall separating adjacent first and second pumping chambers, wherein said ion guide has a first portion, in which gaps are formed between at least some of said electrode plates such that uncharged gas can escape from said ion guide volume, wherein said first portion is completely located in said first pumping chamber, and a second portion, in which sealing elements are arranged between adjacent electrode plates, preventing neutral gas from escaping from the ion guide volume between adjacent electrode plates, said second portion extending at least from said separation wall into said second pumping chamber, wherein said method further comprises a step of driving each adjacent two electrode plates with RF voltage of opposite polarity.

In a preferred embodiment, the method comprises a step of driving each adjacent two electrode plates with an RF square wave signal or a superposition of RF square wave signals, wherein the method further comprises a step adjusting the RF frequency and the voltage amplitude of the drive signal depending on the type of ions to be guided by said ion guide.

In preferred embodiments of said method, said ion guide is an ion guide according to one of the embodiments described above.

A further aspect of the invention relates to a method of manufacturing an ion guide according to any one of the embodiments described above, wherein at least the second portion of said ion guide, comprising alternating electrode plates and sealing elements, is formed by 3D printing. This 3D printing can be carried out by alternatingly forming electrode plates, for example from a plastic material mixed with graphene, carbon nanotubes, carbon fibers, soot, graphite or metal or a ceramic material mixed with metal or metal oxides, and sealing elements, which can be made from similar materials, but with a lower concentration of conductive components.

A further aspect of the invention relates to an ion guide suitable for use as said second portion in an ion guide of one of the embodiments described above. This ion guide can be manufactured and marketed by itself as an intermediate product, which can be complemented by additional electrode plates with gaps in between to form the above-mentioned first portion of the full ion guide. The ion guide of this aspect of the invention comprises a plurality of electrode plates which are arranged perpendicularly to the longitudinal axis, each electrode plate having an opening and being arranged such that said longitudinal axis extends through its respective opening, wherein said openings collectively define an ion guide volume, wherein sealing elements are arranged between adjacent electrode plates, preventing neutral gas from escaping from the ion guide volume between adjacent electrode plates, wherein some or all of said sealing elements are made from an intermediate resistivity material having an electrical resistivity of between $10^2$ Ohm·cm and $10^{12}$ Ohm·cm, preferably of between $3.10^9$ Ohm·cm and $10^9$ Ohm·cm, or have a sheet resistivity of between $10^4$ Ohm and $10^{14}$ Ohm, preferably of between $3.10^2$ Ohm and $10^{10}$ Ohm on a surface facing said ion guide volume.

In a preferred embodiment, the intermediate resistivity material is a plastic material or a ceramic material including or mixed with conductive particles, in particular metal or graphite particles, or a ferrite based material.

In a preferred embodiment, said intermediate resistivity material is a material suitable for 3D printing, and in particular a plastic material mixed with graphene, carbon nanotubes, carbon fibers, soot, graphite or metal or a ceramic material mixed with metal or metal oxides.

In a preferred embodiment, some or all of said sealing elements are coated at least on a surface facing said ion guide volume with a coating suitable for draining stray ions to thereby avoid static charging of said sealing elements by stray ions. Herein, said coating is preferably a metal film having a thickness of 30 to 1000 nm, or a paste containing glass and metal oxides, wherein said paste preferably has a thickness of 5 to 1000 μm.

In a preferred embodiment, at least some of the sealing elements are flush with the opening in one or both of its adjacent electrode plates or are retracted from the opening in one or both of its adjacent electrode plates in a radially outward direction by less than 3 times, preferably by less than 1.5 times and most preferably by less than 1.0 times the distance between the corresponding adjacent electrode plates.

In a preferred embodiment, at least some of the electrode plates in the second portion and corresponding intermediate sealing elements are both made from a material suitable for 3D printing, and in particular a plastic material mixed with graphene, carbon nanotubes, carbon fibers, soot, graphite or metal or a ceramic material mixed with metal or metal oxides. A further aspect of the invention relates to a method of manufacturing such an ion guide, wherein said ion guide is formed by 3D printing.

In a preferred embodiment, the first TWIN is followed by a third portion in which gaps are formed between adjacent electrode plates to remove neutral background gas by another pump, followed by a fourth sealed portion connecting two further adjacent pumping chambers and so on . . .

SHORT DESCRIPTION OF THE FIGURES

DESCRIPTION OF THE PREFERRED EMBODIMENTS

Figure 1:
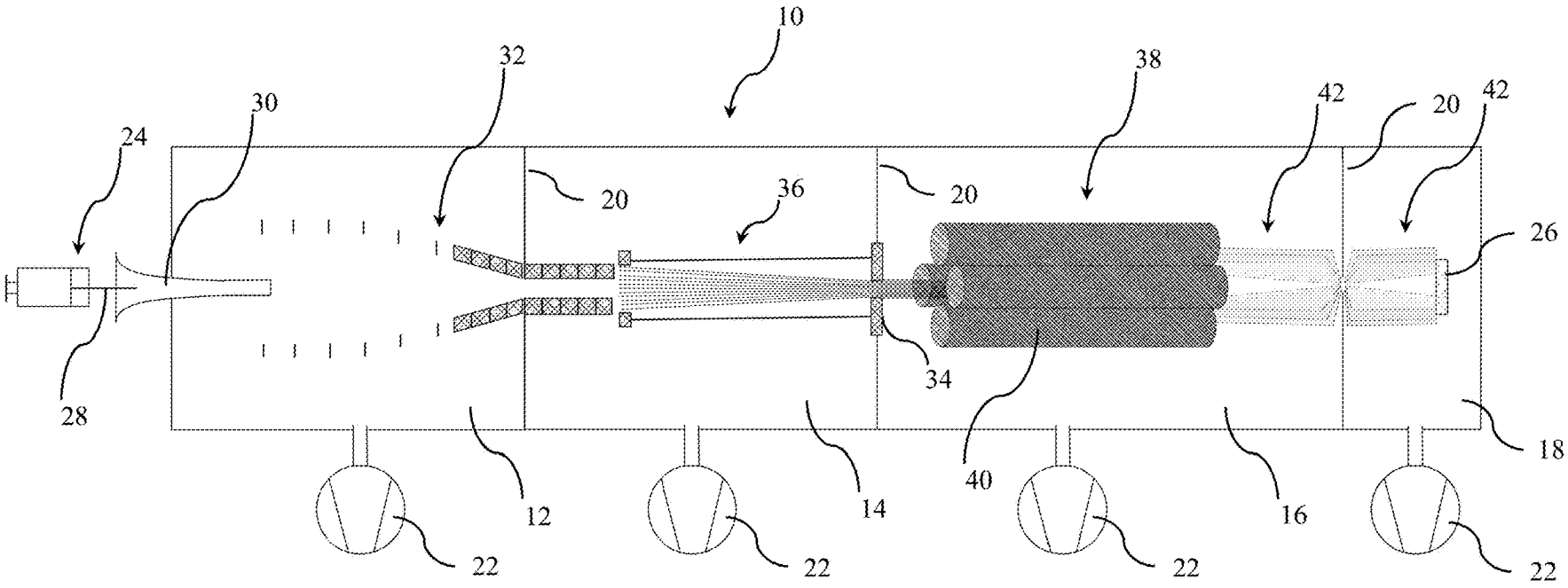
FIG. 1 is a schematic view of an ion beam deposition system employing a TWIN ion guide according to an embodiment of the present invention.

For the purposes of promoting an understanding of the principles of the invention, reference will now be made to preferred embodiments illustrated in the drawings, and specific language will be used to describe the same. It will nevertheless be understood that no limitation of the scope of the invention is thereby intended, such alterations and further modifications in the illustrated apparatus and such further applications of the principles of the invention as illustrated therein being contemplated as would normally occur now or in the future to one skilled in the art to which the invention relates.

In the figures described below, like elements will be designated with like reference signs, and the description thereof will not be repeated.

FIG. 1 shows a schematic illustration of an ion beam deposition (IBD) system 10. The IBD system 10 comprises first to fourth pumping chambers 12 to 18 separated by separation walls 20. Each of the pumping chambers 12 to 18 is connected with a corresponding vacuum pump 22. While all of the vacuum pumps are designated with the same reference sign 22, they may be of different types. On the left end of the IBD system 10, an electrospray ionization (ESI) device 24 is provided, in which molecules are ionized such as to generate the molecular ions to be used for eventual deposition on a substrate 26 located in the fourth chamber 18 at the very right of the figure. The ESI method has first been described in Malcolm Dole, L. L. Mack, R. L. Hines, R. C. Mobley, D. Furgeson, M. B. Alice, *Molecular Beams of Macroions, JChemPhys* 49 p. 2240 (1968). A noble prize had been awarded to John B. Feen for this method, see John B. Fenn, *Electrospray Wings for Molecular Elephants* (*Nobel Lecture*), *AngewChemIntEd* 42 p. 3871 (2003). In the ESI device 24, charged droplets of an electrolyte are drawn by a very high voltage from a needle 28 which is operated at atmospheric pressure. Each droplet includes, in addition to the charged molecules to be deposited, a large amount of unwanted solvent/carrier gas that needs to be removed by means of the pumps 22 connected to the succession of pumping chambers 12 to 18. The ions and the solvent/carrier gas are guided into the first pumping chamber 12 by means of a heated capillary 30.

The first pumping chamber 12 exhibits a pressure of between 0.1 and 10 mbar. For forming an ion beam, a combined ion funnel and tunnel device 32 according to an embodiment of the invention is employed, which extends from the first pumping chamber 12 through an aperture in the separation wall 20 into the second pumping chamber 14. The combined ion funnel and tunnel device 32 is referred to as a TWIN guide 32 herein.

An electrode wire based ion guide 36 is schematically shown, which extends from the second pumping chamber 14 through an opening in the separation wall 20 into the third pumping chamber 16. Wire based ion guides may be referred to as a "wire ion guide" (WIG) for short and are described in more detail in the co-pending patent application "Ion guide comprising electrode wires and ion beam deposition system", the content of which is included herein by reference. Herein, a portion of the WIG forms an aperture 34 through which neutral gas molecules can inadvertently pass from one chamber to the other.

In the third pumping chamber 16, a quadrupole mass separator 38 is provided, which comprises four rod electrodes 40. Also in the third pumping chamber 16, a first plate or "blade" based ion guide (BIG) 42 is arranged, which is described in more detail in the co-pending patent application "Ion guide comprising electrode plates and ion beam deposition system". As is seen in the schematic representation, the first BIG 42 has a conical ion guide volume with a large diameter upstream end facing the quadrupole mass separator 38 and a small diameter downstream end facing the separation wall 20 between the third and fourth pumping chambers 16, 18. Moreover, at the downstream end of the first BIG 42, the electrode plates or "blades" have a pointed tip, as is further explained in said co-pending application "Ion guide comprising electrode plates and ion beam deposition system". Finally, a second BIG 42 is provided in the fourth pumping chamber 18, having a conical ion guide volume with a small diameter upstream end facing the separation wall 20 between the third and fourth pumping chambers 16, 18, and a large diameter downstream end facing the substrate 26. Moreover, at the upstream end of the second BIG 42, the electrode plates or "blades" have a pointed tip.

FIGS. 2 to 5 show schematic sectional views of TWIN ion guides 32 according to various embodiments of the present invention. FIGS. 2 to 5 are schematic in that they only show the electrode plates 44, the sealing elements 46 and the separation wall 20, but e.g. leave out any mounting structure for clarity. Moreover, FIGS. 2 to 5 are further schematic in that they are not drawn to scale, as the true extension in the direction of the longitudinal axis 48 would be longer than shown in the figures. Specific embodiments drawn to scale are shown in FIGS. 6 to 9 below.

Each of the TWIN ion guides 32 shown in FIGS. 2 to 5 is configured for guiding an ion beam along an ion path and has a longitudinal axis 48 corresponding to said ion path. Moreover, each of the TWIN ion guides 32 comprises a plurality of electrode plates 44 which are arranged perpendicularly to the longitudinal axis 48. Each of the electrode plates 44 comprises an opening and is arranged such that said longitudinal axis 48 extends through its respective opening. The openings collectively define an ion guide volume 49. As further seen in FIGS. 2 to 5, the TWIN ion guide 32 extends through a separation wall 20 dividing adjacent first and second pumping chambers, such as the pumping chambers 12 and 14 shown in FIG. 1.

Each of the TWIN ion guides 32 has a first portion 52 in which gaps are formed between adjacent electrode plates 44 such that uncharged gas can escape from the ion guide volume 49. The first portion 52 is completely located in the first pumping chamber 12, i.e. to the left of separation wall 20.

Each of the TWIN ion guides 32 further has a second portion 54 in which sealing elements 46 are arranged between adjacent electrode plates 44. The sealing elements 46 prevent neutral gas from escaping from the ion guide volume between adjacent electrode plates 44. In the embodiments shown, the sealing elements 46 are formed by annular discs which also serve as spacers to adjust the distance between adjacent electrode plates 44. The dashed line 50 indicates the boundary between the first and second portions 52, 54 of said TWIN ion guide 32. As is seen in each of the embodiments of FIGS. 2 to 5, the first portion 52 is completely located in the first pumping chamber 12, and the second portion 54 extends through said separation wall 20 into said second pumping chamber 14. In some embodiments, for example the embodiments of FIGS. 2 and 3, the major part of the second portion 54 is also located in the first pumping chamber 12, and only a small (in principle arbitrarily small) portion thereof extends into the second pumping chamber 14. In other embodiments, for example the embodiments of FIGS. 4 and 5, approximately half of the second portion 54 extends into the second pumping chamber 14, and in other embodiments (such as the embodiment shown in FIGS. 6 to 8), the major part or all of the second portion 54 may extend into the second pumping chamber 14. All of these variants are covered by the aforementioned feature, according to which the second portion 54 extends "at least" from said separation wall 20 into said second pumping chamber 14. The embodiment according FIG. 5 depicts a special sequence of the diameter of the holes of the electrode plates. There is not an abrupt change in hole diameter in downstream direction from left to right in FIG. 5. Starting from a constant hole diameter, it is reduced slightly, enters a constant decreasing region and finally tapers off in a region of constant diameter. Especially the tapering off leads to a smoother transition of the beam of neutral gas entering the tube with constant hole diameter of the tunnel. Thus the ions undergo a smoother transition into the tunnel as well, leading to fewer ion losses and a higher current capacity.

The electrode plates 44 can be made from copper, molybdenum, tungsten, nickel, or compounds or alloys thereof. The electrode plates 44 can also be made from stainless steel. It is also possible to plate the electrode plates with silver or gold.

The electrode plates 44 in said second portion 54 of the ion guide 32 may have a thickness of 3 mm or less, preferably of 1 mm or less, more preferably of 0.3 mm or less, and most preferably 0.1 mm or less. However, the thickness is preferably 0.01 mm or more, preferably of 0.02 mm or more and most preferably of 0.03 mm or more. The average distance between adjacent electrode plates 44 in the second portion 54 is similar to the thickness, and in the embodiment shown, it is actually identical.

Moreover, the ratio of the diameter of the opening in each electrode plate 44 and the distance to one of its adjacent electrode plates 44 may be between 2000 and 1.0, preferably between 2000 and 2.0. Note that this ratio cannot be discerned from FIGS. 2 to 5, since these figures are not drawn to scale in this regard.

Figure 2:
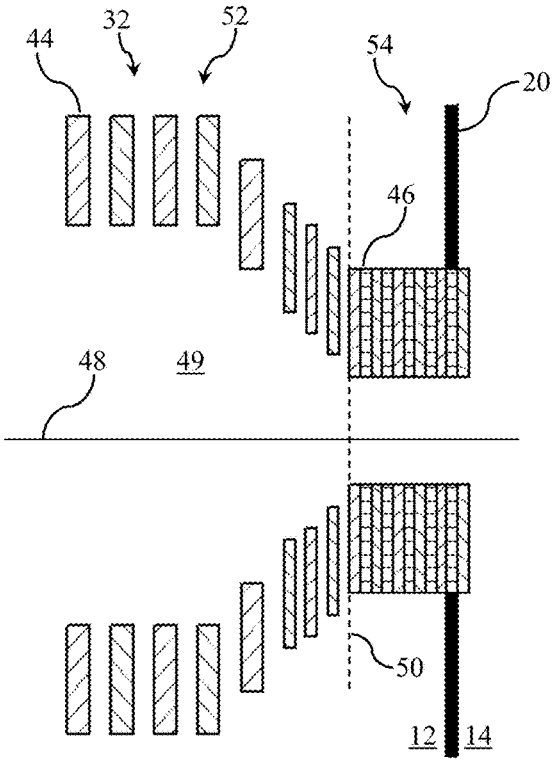
FIG. 2 is a schematic sectional view of a TWIN ion guide according to an embodiment of the present invention.
Figure 3:
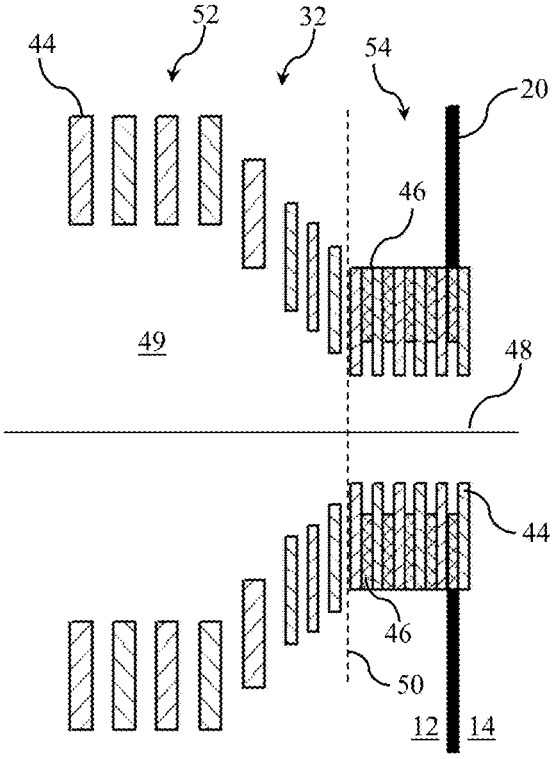
FIG. 3 is a schematic sectional view of a TWIN ion guide according to a further embodiment of the present invention.
Figure 4:
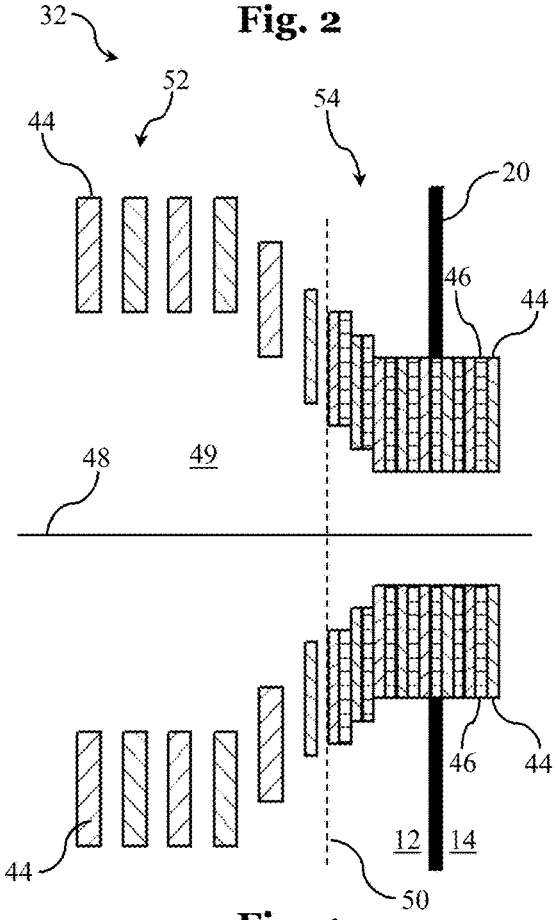
FIG. 4 is a schematic sectional view of a TWIN ion guide according to a yet further embodiment of the present invention.
Figure 5:
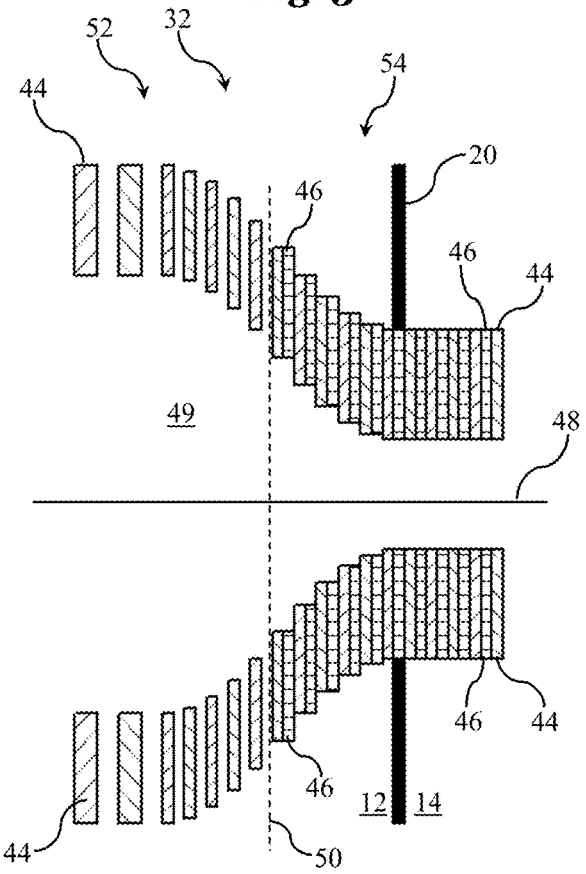
FIG. 5 is a schematic sectional view of a TWIN ion guide according to a yet further embodiment of the present invention.

In the TWIN ion guides 32 of FIGS. 2,4 and 5, the sealing elements 46 in the second portion 54 are flush with the opening in one or both of its adjacent electrode plates 44. In the embodiment of FIG. 3, the sealing elements 46 are retracted from the opening in one or both of its adjacent electrode plates 44 in a radially outward direction. When the sealing elements 46 are flush with the opening in the adjacent electrode plates 44, the inner volume of the tunnel structure of the second portion 54 is minimum. Moreover, the flush configuration is advantageous for the purpose of 3D printing described below. While retracting the sealing elements 46 in the manner shown in FIG. 3 and FIG. 5 slightly increases the inner volume, it leads to a "rough" inner surface which causes turbulences in the gas flow and can thereby help to decrease the gas conductance and thereby reduce the gas load. A similar increase of turbulences can be generated by 3D printing, when there is a slight smooth modulation of the inner diameter between spacer and plate.

The natural choice for the sealing elements 46, which act as spacers between adjacent electrode plates 44, would be an insulating material, such as to insulate adjacent electrode plates 44 from each other, which an operation will be driven with opposite phase and hence opposite polarity at any given instant in time. However, in the flush configuration, or when the seeming elements 46 are retracted only to a small extent, such as less than 3.0 times, less than 1.5 times or even less than 1.0 times the distance between the corresponding adjacent electrode plates 44, there is a risk that the sealing elements 46 are hit by stray ions, which in case of insulating material would lead to a charging and consequently a distortion of the electric field for guiding the ion beam, and in consequence to a reduction of the current capacity. In view of this problem, according to various embodiments of the invention, the sealing elements 46 are made from an intermediate resistivity material having an electrical resistivity of between $10^2$ Ohm·cm and $10^{12}$ Ohm·cm, preferably of between $3.10^5$ Ohm·cm and $10^9$ Ohm·cm. The intermediate resistivity material may e.g. be a plastic material or a ceramic material including or mixed with conductive particles, in particular metal or graphite particles, or a ferrite based material. Particularly preferred are plastic materials mixed with graphene, carbon nanotubes, carbon fibers, soot, graphite or metal, or a ceramic material mixed with metal or metal oxides, since they allow for 3D printing. Using the "intermediate resistivity material" with a resistivity chosen from the above ranges, stray ions can be drained, while the resistivity is still high enough to prevent short circuit of the adjacent electrode plates 44.

Instead of making the sealing elements 46 completely from intermediate resistivity material, for the purpose of draining the stray ions it may be sufficient to provide for a suitably high sheet resistivity on at least a surface facing the ion guide volume, preferably any surface facing the ion guide volume 49. Suitable sheet resistivity values for this purpose range between $10^4$ Ohm and $10^{14}$ Ohm, preferably between $3.10^7$ Ohm and $10^{10}$ Ohm. In some embodiments, the bulk of the sealing elements 46 may be an electrically insulating material, such as a ceramic material, where at least on a surface facing said ion guide volume, a coating suitable for draining stray ions is provided, to thereby avoid static charging of said sealing elements 46 by stray ions. Such coating may involve a metal film having a thickness of 30 to 1000 nm, or a paste or "cement" containing glass and metal oxides, wherein said paste or cement may have a thickness of 5 to 1000 μm.

As is further seen in the TWIN ion guides 32 of FIG. 2 to FIG. 5, the diameters of the openings in a subset of consecutive electrode plates 44 of the first portion 52 decrease in a direction towards the center of the ion guide 32, to thereby form a "funnel structure". Herein, the term "funnel structure" indicates that the ion guide volume 49 tapers from the entrance of the TWIN ion guide 32 (at the left in FIGS. 2 to 5) along the longitudinal axis 48 in a direction towards the second portion 54, thereby allowing a less concentrated or "fuzzy" ion beam to be received and focused prior to introducing it into the second portion 54, which forms a gas tight "tunnel".

In the embodiment of FIG. 2 and FIG. 3, the funnel structure is completely formed within the first portion 52, while the ion guide volume 49 in the entire second portion 54 is cylindrical. In contrast to this, in the embodiments of FIG. 4 and FIG. 5, the funnel structure is predominantly formed in said first portion 52 but extends into the second portion 54 of the ion guide 32. Note that in the first portion 52, neutral gas flows mainly radially outside through the gaps between adjacent electrode plates 44, while in the second portion 54, such radial flow is blocked by the sealing elements 46, such that neutral gas flows only in a longitudinal direction, namely towards the second pumping chamber 14, which has a lower pressure than the first pumping chamber 12. In other words, at the interface between the first and second portions 52, 54, which is highlighted by a dashed line 50 in FIGS. 2 to 5, the direction of gas flow changes. The inventors have found out that best results with regard to gas load and current capacity can be achieved if this change in gas flow direction does not coincide with the location where the ion beam has reached its maximum concentration. Accordingly, while it is possible to employ a funnel structure in the first portion 52 and a cylindrical structure in the second portion 54, as shown in FIG. 2 and FIG. 3, in preferred embodiments the funnel structure is actually extended into the second portion 54, as shown in FIG. 4 and FIG. 5, such that the ion beam is only maximally concentrated after the change in the gas flow direction from radial to longitudinal has occurred.

Moreover, in the embodiments shown in FIG. 2 and FIG. 3, the funnel structure defines a "linear decrease" in the cross-section of the ion guide volume 49 along the longitudinal axis 48 (the ion guide volume 49 itself consequently decreases quadratically). In other words, in the embodiments of FIG. 2 in FIG. 3, the quotient of the difference between the diameters of the openings in adjacent electrode plates 44 divided by the distance between these adjacent electrode plates 44 in the funnel structure region is constant. However, the inventors have found that this is not the optimum structure with regard to a high current capacity, and that a smoother transition between the funnel structure portion and the cylindrical portion is actually advantageous. An advantageous structure in this regard is shown in FIG. 4 and FIG. 5, where the quotient of the difference between the diameters of the openings in adjacent electrode plates 44 divided by the distance between these adjacent electrode plates 44 decreases gradually in downstream direction.

In addition, as is seen in each of the embodiments of FIGS. 2 to 5, the spacing between at least some adjacent electrode plates 44 in the first portion 52 is larger than the spacing between at least some adjacent electrode plates 44 in the second portion 54. The spacing between adjacent electrode plates 44 in the first portion 52 may for example be larger by a factor of at least 1.5, preferably by a factor of at least 3 than the spacings between adjacent electrode plates 44 in the second portion 54. Namely, since the ion beam in the first portion 52 is less focused than in the second portion 54, and the repulsive forces that need to be overcome by the RF field generated by the electrode plates 44 are smaller, it is possible to safely confine the ions even with larger spacings between the adjacent electrode plates 44.

Finally, it ought to be noted that the first and second portions 52 and 54 are seamlessly connected and that in particular, no DC lens is arranged between said first and second portions of said ion guide.

Figure 6:
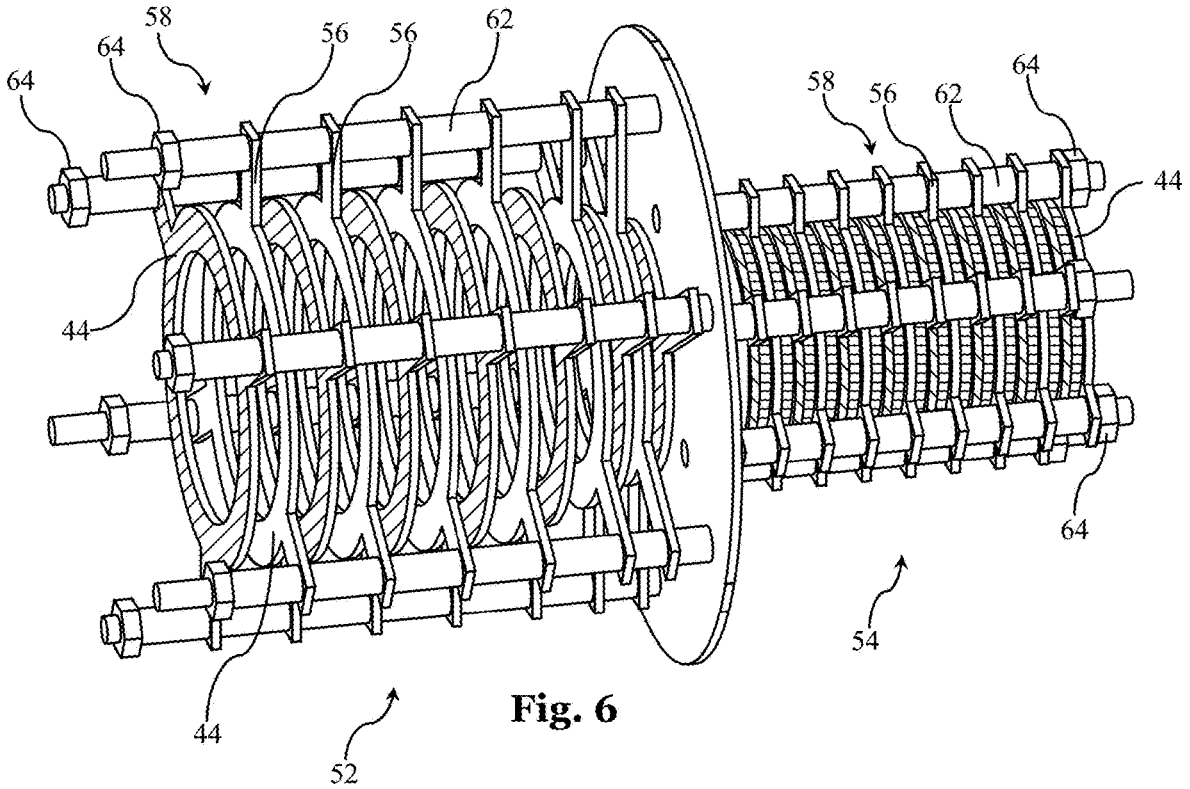
FIG. 6 is a perspective view of a TWIN ion guide according to an embodiment of the present invention.
Figure 7:
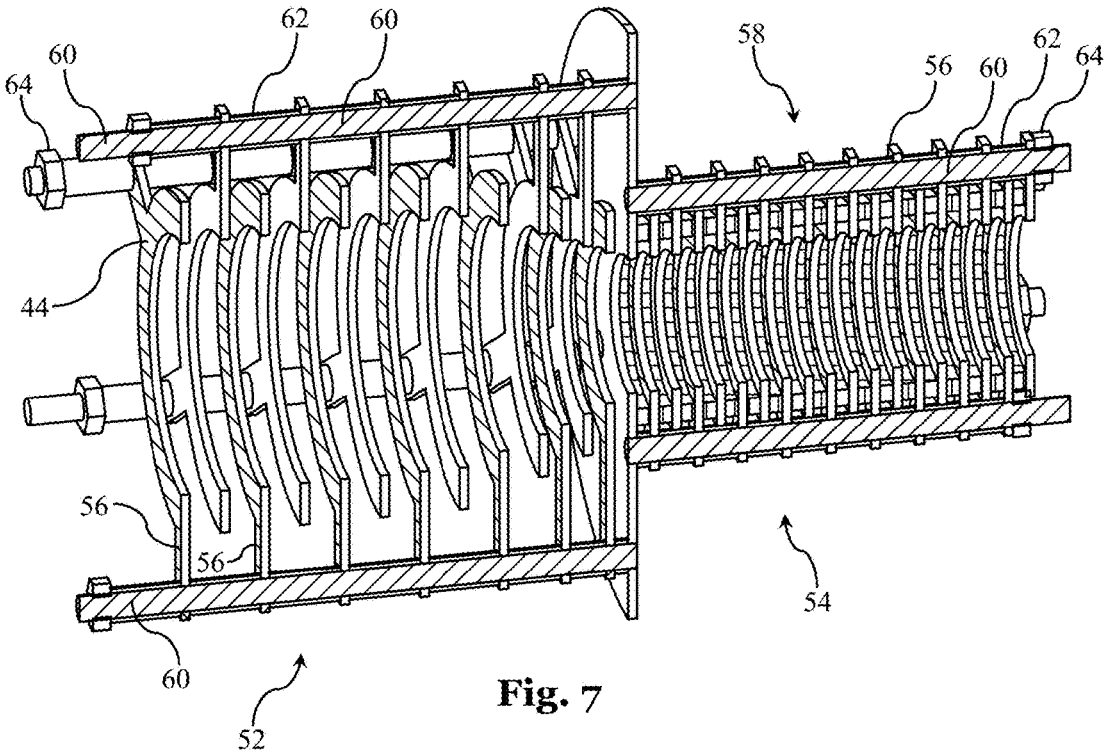
FIG. 7 is a perspective sectional view of the TWIN ion guide of FIG. 6.
Figure 8:
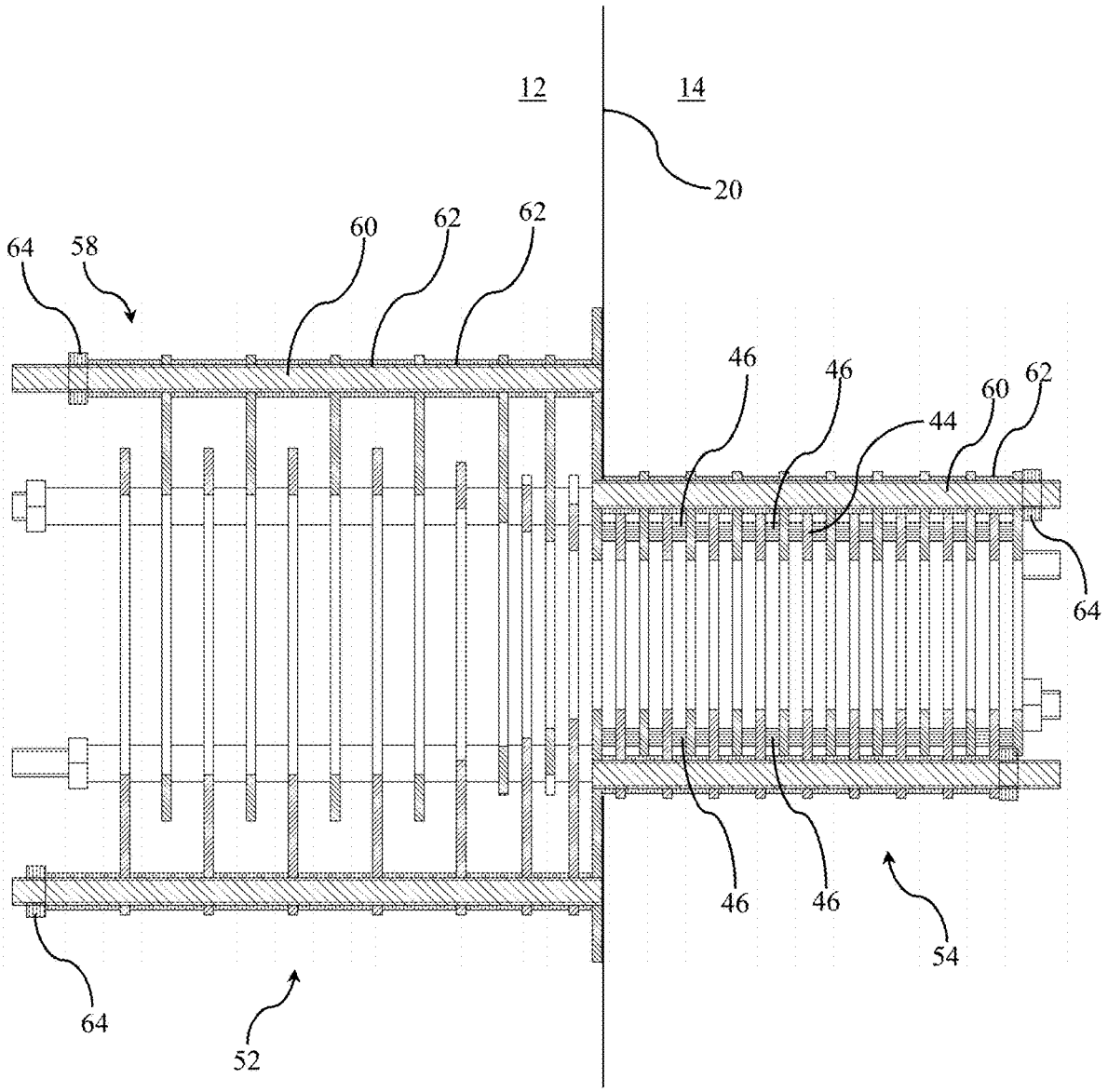
FIG. 8 is a sectional view of the TWIN ion guide of FIGS. 6 and 7.

FIGS. 6 to 8 show in more detail a TWIN ion guide 32 according to an embodiment of the present invention. FIG. 6 shows a perspective view of the TWIN ion guide 32, FIG. 7 shows a perspective sectional view of the TWIN ion guide 32 and FIG. 8 a sectional view thereof. As seen therein, each of the electrode plates 44 is formed by comparatively narrow annular elements comprising three radially extending mounting portions 56 connected to a corresponding mounting structure 58. The radially extending mounting portions 56 are arranged at angles of 120°. Each adjacent two electrode plates 44 are rotated by 60° with respect to each other. This allows for connecting the mounting portions 56 of odd-numbered electrode plates 44 to three corresponding first common mounting structures 58, and for connecting the mounting portions 56 of the even-numbered electrode plates 44 to three corresponding second common mounting structures, which are different from said three first common mounting structures 58. More generally, each of the electrode plates 44 may have N mounting portions 56, arranged at angles of 360°/N, and adjacent electrode plates 44 may be rotated with respect to each other by 180°/N.

The mounting structures 58 can be best understood from FIG. 8. Each mounting structure 58 comprises a rod 60 which is fed through openings, so-called eyelets, in the mounting portions 56 of the electrode plates 44. Distances between the actual plates 44 are controlled by spacer elements 62 which are arranged between adjacent mounting portions 56 on the rod 60. A fine tuning of the distances can be achieved by tightening a nut 64, allowing for collectively compressing or relaxing the spacers 62 to thereby fine-tune the total length of the stack of odd-numbered or even-numbered electrode plates 44. With this type of mounting, there are essentially two interleaved stacks of electrode plates 44, i.e. a stack of odd-numbered and a stack of even-numbered electrode plates 44, and the precise extension of the stacks in longitudinal direction can be fine-tuned by operating the nuts 64.

Note that in operation, adjacent electrode plates 44 are driven with opposite phase, and hence opposite electrical polarity at any given point in time, but every other electrode plate 44, i.e. all odd-numbered and all even-numbered electrode plates 44, respectively, are driven with the same polarity. In other words, only electrode plates that are driven with the same polarity share a common mounting structure 58. This has two important advantages. One advantage is that the mounting structures 58 can be used for connecting all electrode plates 44 connected thereto with the RF voltage source (not shown). The other advantage is that only the mounting portions 56 of electrode plates 44 overlap with each other which are driven with the same polarity, such that they do not contribute to the capacity of the TWIN ion guide 32, since they have the same voltage at any point in time. This would be different if mounting portions 56 of adjacent, i.e. oppositely driven electrode plates 44 were overlapping (rather than shifted by 60° (180°/N) with respect to each other), where the overlap would indeed contribute severely to the capacity. This is even more true since the spacer elements 62 typically have a relative dielectric constant of 2 to 4 such that in principle, the mounting portions 56 would contribute considerably to the overall capacity.

Note that one of the electrode plates 44 in the TWIN ion guide 32 of FIGS. 6 to 8 is enlarged and hence forms a diaphragm that can be used to close a larger opening in the separation wall 20, or essentially to form part of the separation wall 20 between adjacent pumping chambers.

Similar to the embodiments shown in FIGS. 2 to 5, the TWIN ion guide 32 of FIGS. 6 to 8 comprises a first portion 52 with gaps between adjacent electrode plates 44, and a second portion 54 with sealing elements 46 arranged between adjacent electrode plates 44, to prevent neutral gas from escaping from the ion guide volume 49 between adjacent electrode plates 44. In this embodiment, the boundary between the first and second portions 52, 54 coincides with the boundary between the first and second pumping chambers 12, 14. The ion guide volume in the first portion 52 has a cylindrical ion guide volume portion at its entry side (left side in FIGS. 6 to 8) and a funnel structure portion tapering towards the second portion 54. The ion guide volume 49 within the second portion 54 is cylindrical.

One mounting structure shown in FIGS. 6 to 8 allows for a very precise arrangement of the electrode plates 44 and the sealing elements 46, the mounting itself is somewhat cumbersome. The manufacturing can be significantly simplified if at least the second portion 54 of the TWIN ion guide 32 is made by 3D printing. For this purpose, both the electrode plates 44 and the sealing elements 46 in the second portion 54 are made from a material suitable for 3D printing, in particular a plastic material mixed with graphene, carbon nanotubes, carbon fibers, soot, graphite or metal or a ceramic material mixed with metal or metal oxides.

Commercially available 3D printing devices allow for adding layers of different materials on top of each other. This typically requires that the melting temperatures of the two materials are at least close to each other, such that an underlying layer is not melted or softened when the successive layer is placed on top of it. When forming the second portion 54 of the ion guide 32, it is possible to use the same or similar plastic materials with different concentrations of conductive particles dispersed therein for forming the "electrode plates" 44 and "sealing elements" 46, respectively, where the "electrode plates" 44 and "sealing elements" 46 in this case correspond to regions of different resistivity within the same printed object.

It is advantageous to print the second portion 54 of the ion guide 32 in an upright position, i.e. with the longitudinal axis 48 in a vertical direction, while consecutively adding horizontal layers corresponding to the electrode plates 44 and sealing elements 46, respectively. In some embodiments, the electrode plates 44 and sealing elements 46 can be printed including their respective openings. With current 3D printing precision, this is possible if the openings have a diameter of e.g. 1 mm or above and the total length of the second portion of the ion guide is for example 100 mm. For smaller openings, it is possible to mechanically form the openings using a high precision drill later on. It is also possible to combine a printing procedure including the openings and a drilling procedure, where the openings in the printed electrode plates 44 and the sealing elements 46 may not be quite large enough yet, but help guiding the drill upon subsequent drilling of the openings. In some embodiments, only the electrode plates 44 and the sealing elements 46 are formed by 3D printing, while further components, such as wirings for electrical connection of the electrode plates with a corresponding RF driving source are added in a conventional way. This keeps the 3D printing process comparatively easy and allows for rather rapid manufacturing. In other embodiments, however, the additional external wiring may be made by 3D printing as well.

Figure 9:
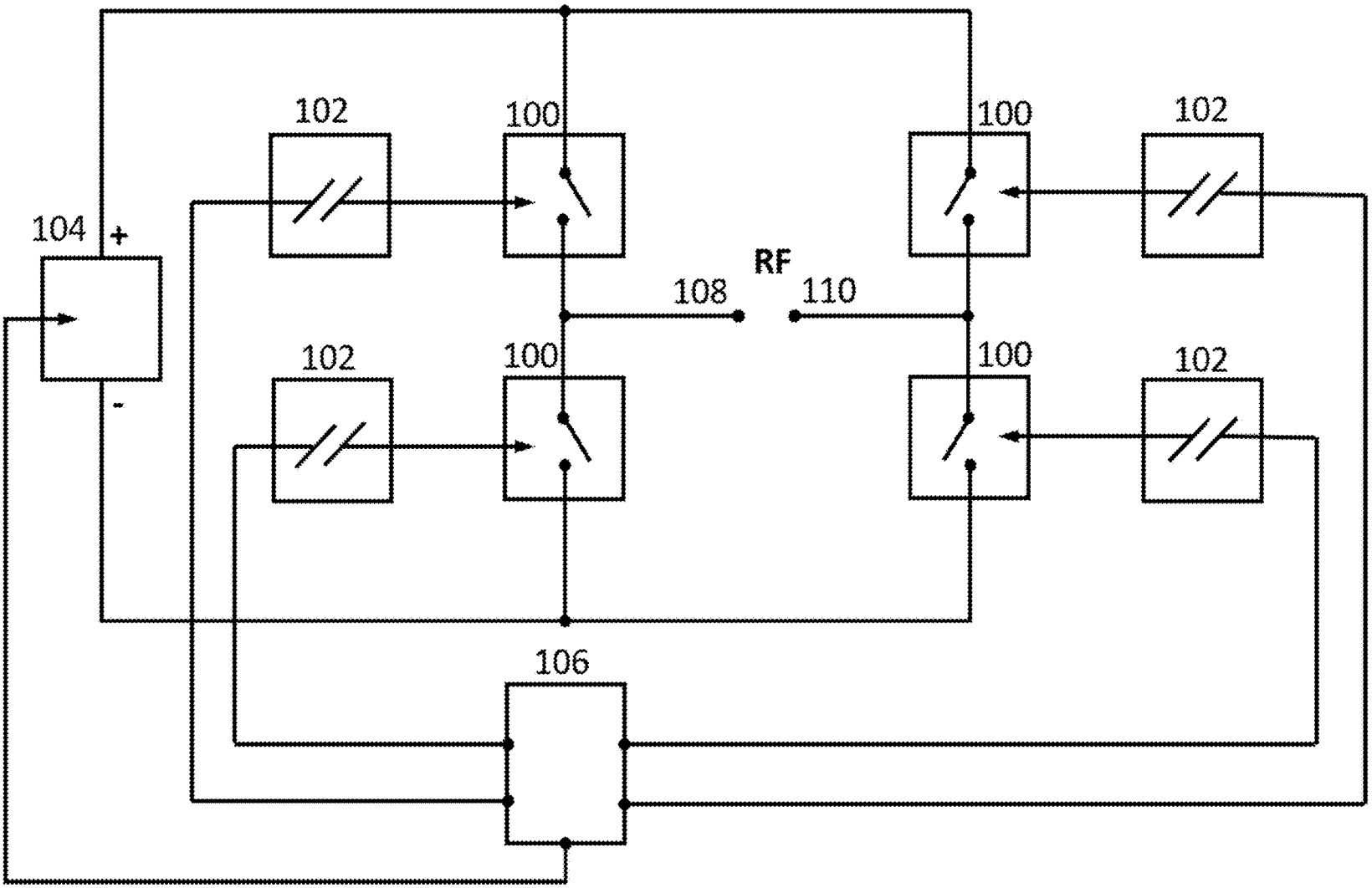
FIG. 9 shows an RF driving circuit for driving the electrode plates of a TWIN ion guide according to an embodiment of the present invention

In operation, high-frequency AC voltages are applied to the electrode plates 44 with frequencies on the order of 0.05-20 MHz and amplitudes of some 0.1-100 V. For clarity of illustration, the corresponding high-frequency driving source is omitted in FIGS. 1 to 8. A circuit diagram of a suitable driving source is shown in FIG. 9. The driving source comprises a DC voltage source 104, four switches 100 and a control unit 106 for controlling the switching states of the switches 100. Between the switches 100 and the control unit 106, potential separating elements 102 are provided. The RF output voltage is supplied at terminals 108 and 110. The control unit 106 controls the switches 100 to alternate between two switching states, a first switching state, in which the upper left and the lower right switch 100 are closed and the remaining switches 100 are open, and a second, opposite state, where the lower left and the upper right switch 100 are closed, and the remaining switches 100 are open. In the first switching state, the RF terminal 108 has positive voltage and the RF terminal 110 has negative voltage, while in the second switching state, the voltages are reversed. Accordingly, by alternating between the first and second switching states, under the control of the control unit 106, a square wave RF output voltage at the terminals 108, 110 is provided. Moreover, under the control of the control unit 106, the output RF frequency can be freely adjusted.

Although a preferred exemplary embodiment is shown and specified in detail in the drawings and the preceding specification, these should be viewed as purely exemplary and not as limiting the invention. It is noted in this regard that only the preferred exemplary embodiment is shown and specified, and all variations and modifications should be protected that presently or in the future lie within the scope of protection of the invention as defined in the claims.

What is claimed is:

1. An ion guide for guiding an ion beam along an ion path, said ion guide having a longitudinal axis corresponding to said ion path, wherein said ion guide comprises a plurality of electrode plates which are arranged perpendicularly to the longitudinal axis, each electrode plate having an opening and being arranged such that said longitudinal axis extends through its respective opening, wherein said openings collectively define an ion guide volume, wherein in operation, said electrode plates are to be connected to an RF driving source for driving adjacent two electrode plates with voltage of opposite polarity, characterized in that the ion guide extends or is configured to extend through a separation wall separating adjacent first and second pumping chambers, wherein said ion guide has a first portion, in which gaps are formed between at least some of said electrode plates such that uncharged gas can escape from said ion guide volume, wherein said first portion is completely located in said first pumping chamber, and a second portion, in which sealing elements are arranged between adjacent electrode plates, preventing neutral gas from escaping from the second portion of the ion guide volume between adjacent electrode plates, said second portion extending at least from said separation wall into said second pumping chamber.

2. The ion guide of claim 1, wherein some or all of said sealing elements are made from an intermediate resistivity material having an electrical resistivity of between $10^2$ Ohm·cm and $10^{12}$ Ohm·cm, or have a sheet resistivity of between $10^4$ Ohm and $10^{14}$ Ohm, on a surface facing said ion guide volume.

3. The ion guide of claim 2, wherein the intermediate resistivity material is one of a plastic material or a ceramic material including or mixed with conductive particles, a ferrite based material, a plastic material suitable for 3D printing that is mixed with one of graphene, carbon nanotubes, carbon fibers, soot, graphite and metal and a ceramic material suitable for 3D printing that is mixed with metal or metal oxides.

4. The ion guide of claim 2, wherein at least some of the sealing elements are flush with the opening in one or both of its adjacent electrode plates or are retracted from the opening in one or both of its adjacent electrode plates in a radially outward direction by less than 3 times the distance between the corresponding adjacent electrode plates.

5. The ion guide of claim 1, wherein some or all of said sealing elements are coated at least on a surface facing said ion guide volume with a coating suitable for draining the charge of stray ions to thereby avoid static charging of said sealing elements by stray ions, wherein said coating is a metal film having a thickness of 30 to 1000 nm, or a paste containing glass and metal oxides having a thickness of 5 to 1000 μm.

6. The ion guide of claim 1, wherein at least some of the electrode plates in the second portion are made from a material suitable for 3D printing which material is formed by one of a plastic material mixed with graphene, carbon nanotubes, carbon fibers, soot, graphite and metal and a ceramic material mixed with metal or metal oxides.

7. The ion guide of claim 1, wherein said sealing elements are formed by annular discs, wherein said annular discs serve as spacers to adjust the distance between adjacent electrode plates.

8. The ion guide of claim 1, wherein in one of said first and second portions, the diameters of the openings in at least a subset of consecutive electrode plates decrease in a downstream direction of the ion guide, to thereby form a funnel structure.

9. The ion guide of claim 8, wherein in at least a portion of said funnel structure, the quotient of the difference between the diameters of the openings in adjacent electrode plates divided by the distance between these adjacent electrode plates decreases gradually in said downstream direction of the ion guide.

10. The ion guide of claim 8, wherein said funnel structure is predominantly formed in said first portion but extends into the second portion of the ion guide.

11. The ion guide of claim 1, wherein said first and second portions of said ion guide are seamlessly connected.

12. The ion guide of claim 1, wherein the spacing between at least some adjacent electrode plates in the first portion is larger than the spacing between at least some adjacent electrode plates in the second portion by a factor of at least 1.5.

13. The ion guide of claim 1 wherein in a transition region between said first and second portions, the spacing between adjacent electrode plates is uniform or at least varies by less than 15%, wherein this transition region comprises at least three electrode plates within each of the first and second portions.

14. The ion guide of claim 1, wherein said electrode plates are formed by annular elements comprising two or more radially extending mounting portions connected to a corresponding mounting structure, wherein the mounting portions of odd-numbered electrode plates are connected to one or more first common mounting structures, and the mounting portions of the even-numbered electrode plates are connected to one or more second common mounting structures different from said one or more first common mounting structures.

15. The ion guide of claim 14, wherein said mounting structures are also used for applying a driving voltage to the electrode plates.

16. The ion guide of claim 1, wherein said electrode plates are connected to an RF driving source configured to drive adjacent two electrode plates with voltages of opposite polarity and freely adjustable radiofrequency.

17. The ion guide of claim 1, wherein said ion guide is part of an ion beam deposition system, in which an ion beam is guided through a plurality of pumping chambers of decreasing pressure, wherein adjacent pumping chambers are separated by separation walls having an aperture for the ion beam to pass through.

18. A method for guiding an ion beam along an ion path using an ion guide according to claim 1, said ion guide having a longitudinal axis corresponding to said ion path, wherein said ion guide comprises a plurality of electrode plates which are arranged perpendicularly to the longitudinal axis, each electrode plate having an opening and being arranged such that said longitudinal axis extends through its respective opening, wherein said openings collectively define an ion guide volume, wherein the ion guide extends through a separation wall separating adjacent first and second pumping chambers wherein said ion guide has a first portion in which gaps are formed between at least some of said electrode plates such that uncharged gas can escape from said ion guide volume, wherein said first portion is completely located in said first pumping chamber, and a second portion, in which sealing elements are arranged between adjacent electrode plates, preventing neutral gas from escaping from the ion guide volume between adjacent electrode plates, said second portion extending at least from said separation wall into said second pumping chamber, wherein said method further comprises a step of driving each adjacent two electrode plates with RF voltage of opposite polarity.

19. The method of claim 18, comprising a step of driving each adjacent two electrode plates with an RF square wave signal or a superposition of RF square wave signals, wherein the method further comprises a step of adjusting the RF frequency and the voltage amplitude of the drive signal depending on the type of ions to be guided by said ion guide.

20. The ion guide of claim 1, wherein some or all of the sealing elements are made from an intermediate resistivity material having an electrical resistivity between $3 \cdot 10^5$ Ohm·cm and $10^9$ Ohm·cm, or have a sheet resistivity of between $10^7$ Ohm and $10^{10}$ Ohm on a surface facing said ion guide volume.

21. A method of manufacturing an ion guide for guiding an ion beam along an ion path, said ion guide having a longitudinal axis corresponding to said ion path, comprising the steps of arranging a plurality of electrode plates perpendicularly to the longitudinal axis, each electrode plate having an opening and being arranged such that said longitudinal axis extends through its respective opening, wherein said openings collectively define an ion guide volume, wherein in operation, said electrode plates are to be connected to an RF driving source for driving adjacent two electrode plates with voltage of opposite polarity, wherein the ion guide extends or is configured to extend through a separation wall separating adjacent first and second pumping chambers, forming, in a first portion of said ion guide gaps between at least some of said electrode plates such that uncharged gas can escape from said ion guide volume, wherein said first portion is completely located in said first pumping chamber, and arranging, in a second portion of said ion guide sealing elements between adjacent electrode plates, said sealing elements preventing neutral gas from escaping from the second portion of the ion guide volume between adjacent electrode plates, said second portion extending at least from said separation wall into said second pumping chamber, wherein at least the second portion of said ion guide, comprising alternating electrode plates and sealing elements, is formed by 3D printing.

* * * * *